United States Patent [19]

Mlyniec et al.

[11] 4,084,147

[45] Apr. 11, 1978

[54] NORMALLY OPEN, THERMAL SENSITIVE ELECTRICAL SWITCHING DEVICE

[75] Inventors: Kenneth P. Mlyniec, Lebanon; Raymond B. Vore, Dayton, both of Ohio

[73] Assignee: Emerson Electric Co., St. Louis, Mo.

[21] Appl. No.: 801,781

[22] Filed: May 31, 1977

[51] Int. Cl.[2] ..... H01H 37/76

[52] U.S. Cl. ..... 337/407; 337/409

[58] Field of Search ..... 337/407, 408, 409

[56] References Cited

U.S. PATENT DOCUMENTS

| | | | |
|---|---|---|---|
| 2,934,628 | 4/1960 | Massar et al. | 337/409 |
| 3,180,958 | 4/1965 | Merrill | 337/409 |

*Primary Examiner*—George Harris

*Attorney, Agent, or Firm*—Biebel, French & Nauman

[57] ABSTRACT

A temperature sensitive normally open electrical switching device has a pair of normally isolated current carrying leads. A casing defines a central cavity and encloses first and second electrodes which are electrically connected to separate ones of the leads. An electrically conductive, fusible pellet is positioned in the cavity and melts at predetermined temperature to form an electrically conductive path between the electrodes. A spring and a nonconductive spacer apply a force to the pellet which will cause the pellet to collapse once the pellet material is fused regardless of the formation of an oxide layer on the pellet surface.

8 Claims, 6 Drawing Figures

NORMALLY OPEN, THERMAL SENSITIVE ELECTRICAL SWITCHING DEVICE

BACKGROUND OF THE INVENTION

The present invention relates to temperature sensitive electrical switching devices and, more particularly, to a temperature sensitive device which is normally open but which closes an electrical circuit when the temperature of the device is raised to a predetermined temperature level.

Thermally actuatable switch constructions are presently known in which an electrical circuit is broken or closed in response to the switch being heated to a predetermined temperature level. In U.S. Pat. No. 3,875,546, issued Apr. 1, 1975, to Merrill, and U.S. Pat. No. 3,519,972, issued July 7, 1970, to Merrill, both assigned to the assignee of the present invention, temperature responsive electrical switches are disclosed in which a sliding electrical contact is held against a second electrical contact by a relatively stiff spring, which spring bears upon a normally solid, heat fusible non-conductive pellet. When the switch is raised to the required temperature and the pellet is melted, the stiff spring no longer opposes the force of a somewhat weaker spring which then moves the sliding contact away from the second contact, thus opening the electrical circuit.

A normally open electrical switching device is disclosed in U.S. Pat. No. 3,180,958, issued Apr. 27, 1965 to Merrill and assigned to the assignee of the present invention. In this device, the heat fusible material holds the sliding contact away from a second contact until the fusion temperature is reached. While sliding contact, thermal switching devices of this type are extremely reliable in operation, there is always a possibility that the moving parts may bind. This is especially critical where the sliding contact is moved into contact with a stationary contact and must press firmly against the stationary contact in order to provide the desired low resistance electrical path through the switch.

A need exists, therefore, for a temperature sensitive switching device which is simple in construction but which provides for closure of an electrical circuit at a precise temperature level, regardless of the orientation of the device.

SUMMARY OF THE INVENTION

A temperature sensitive electrical switching device, having first and second current carrying electrical leads, completes an electrical circuit between the first and second electrical leads when the temperature of the switching device exceeds a predetermined temperature level. A hollow cylindrical electrically conductive case has a first end defining an opening into the central cylindrical cavity and a second end which is closed, said case being electrically connected to said first electrical lead. An electrically conductive member is electrically connected to the second lead and is held by a non-conductive means such that it extends into the cylindrical cavity and the opening into the cavity is sealed. A heat fusible electrically conductive pellet is positioned in the cavity such that the case and the conductive member are electrically isolated. Means are also provided in the cavity for providing a force to the pellet to cause the pellet to fuse at a predetermined temperature level and provide an electrical circuit between the case and the member. Surface activation of the pellet will therefore not affect the actuation temperature level of the device.

A spring and a non-conductive spacer may apply the force to the pellet with the non-conductive spacer abutting the pellet in the cylindrical cavity and the spring urging the spacer into contact with the pellet. The pellet is held against the conductive member and out of contact with the conductive case by the spacer and the spring.

The pellet may be annular in shape and define a cylindrical cavity into which pellet engaging portions of the spacer and the conductive member extend.

Alternatively, the pellet may be substantially spherical. The spacer will define a recess and the spherical pellet will be held out of engagement with the case by the recess. Grooves in the spacer means are defined which extend outwardly from the recess to the periphery of the spacer to provide paths for the flow of melted pellet material after the pellet is fused.

Accordingly, it is an object of the present invention to provide a switch which completes an electrical circuit when heated to a predetermined temperature level; to provide such a switch in which no sliding contact mechanisms are used but in which the predetermined temperature level for actuation of the switch is controlled precisely; to provide such a switch in which the predetermined temperature for switch actuation may be set to various levels; and to provide such a switch which is simple to assemble and economical to produce.

Other objects and advantages of the present invention will be apparent from the following description, the accompanying drawings and the appended claims.

DETAILED DESCRIPTION OF THE PREFERRED EMBODIMENTS

Figure 1:
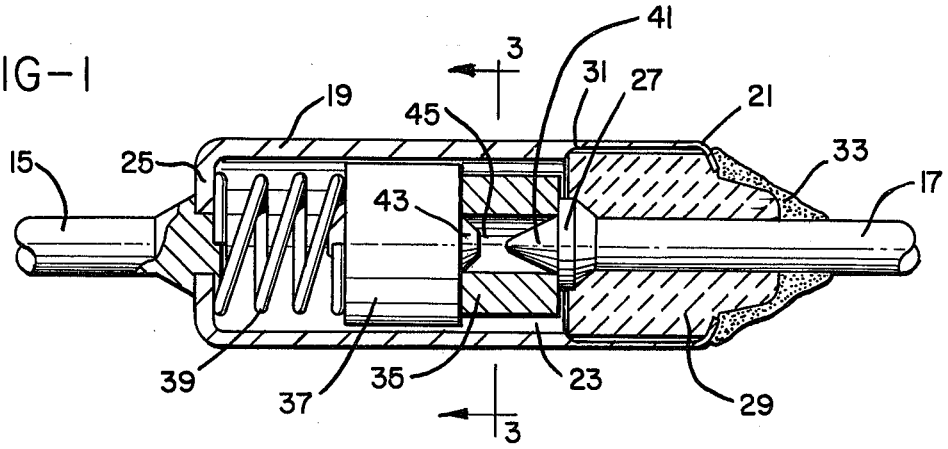
FIG. 1 is a partial sectional view taken generally axially with respect to a first embodiment of the present invention, prior to actuation.

Reference is now made to FIG. 1 in which an axial sectional view of a first embodiment of the temperature sensitive switching device of the present invention is shown. The switching device has first and second current carrying electrical leads 15 and 17 and provides a completed electrical circuit between these leads when the temperature of the switch exceeds a predetermined temperature level. A hollow electrically conductive case 19 has a first end 21 defining an opening into a central cavity 23 and a second end 25 which is closed. Case 19 is electrically connected to the first electrical lead 15.

An electrically conductive member 27 comprises a cylindrical post which is electrically connected to the second electrical lead 17. Non-conductive means for mounting the member 27 such that it extends into the cavity 23 and for sealing the opening into the cavity 23 includes a ceramic bushing 29 which is held in place by a groove 31 in case 19. The outer end 21 of case 19 is crimped inwardly against a shoulder of the ceramic bushing 29 to secure it in place. A sealing compound 33 covers the end of the bushing and seals the opening into the cavity.

A heat fusible electrically conductive pellet 35, dimensioned to engage the electrically conductive member 27 without electrically contacting the case 19 is fusible at a predetermined temperature level to form a volume of electrically conductive liquid which will establish an electrically conductive path between the case 19 and member 27. The pellet may be made of a number of alloy compositions. A bismuth alloy having 55.5 per cent bismuth and 44.5 per cent lead by weight has been found to provide switch actuation by melting at approximately 255° F.

Such a metallic pellet may, however, have an oxide coating formed on its outer surface. This coating will not melt at the predetermined temperature level but may have a substantially higher fusion temperature. Although not extremely strong, the coating may maintain the structural integrity of the pellet when the pellet is heated to its fusion temperature and thus not permit the pellet to melt at precisely the desired temperature. The strength of the oxide coating will vary depending upon its thickness and unacceptable temperature actuation level variations will result.

It has been found that by applying a slight force to the pellet, a uniform temperature actuation level may be obtained since the outer oxide coating will be crushed after the unoxidized interior pellet material has fused. This force is applied by spacer means 37 and spring means 39. The non-conductive spacer means 37 abuts pellet 35 and is urged by spring means 39 into contact with the pellet 35, such that a sufficient force is applied to the pellet to reduce the undesirable effects of an oxide coating on the pellet surface.

Figure 3:
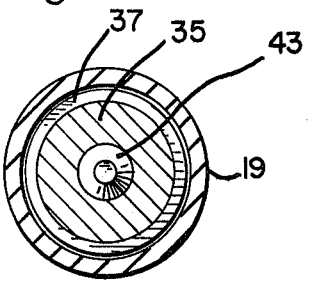
FIG. 3 is a sectional view taken generally along line 3—3 in FIG. 1.

The pellet shown in FIG. 1 is generally annular in shape and is positioned such that it surrounds the member 27. Conductive member 27 and non-conductive spacer means 37 each include pellet engaging portions 41 and 43, respectively, which are dimensioned to extend into the cylindrical cavity 45 of the pellet 35 and hold the pellet 35 out of engagement with the case 19 until the pellet is fused. As seen in FIG. 3, the pellet engaging portion 43 may comprise a cone or truncated cone which will facilitate assembly of the temperature sensitive switch parts. During assembly, the spring 39 and spacer means 37 are inserted into cavity 23 in case 19. Pellet 35 is then inserted into cavity 23 and the pellet will tend to center itself in the cavity as it slips over the pellet engaging portion 43. Similarly conductive member 27 will tend to be centered as portion 41 engages pellet 35.

Figure 2:
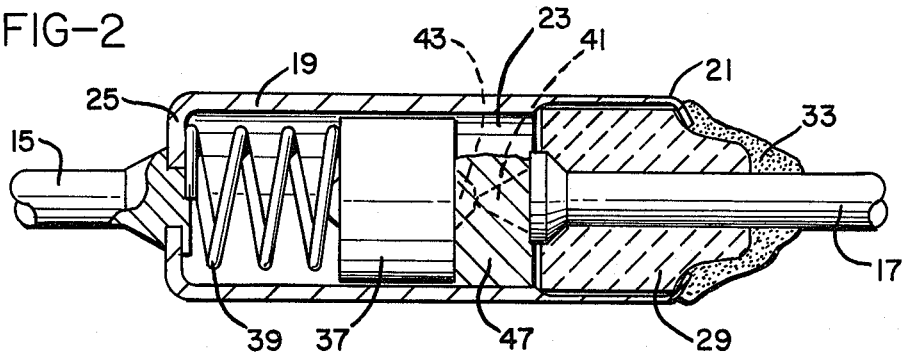
FIG. 2 is a sectional view similar to FIG. 1. showing the switch condition after the switch of FIG. 1 is heated sufficiently to cause switch actuation.

As the pellet fuses, the non-conductive spacer means 37 will move slightly toward the conductive member 27, as seen in FIG. 2. This will have the added benefit that the volume of the cavity 23 in case 19 within which the fused pellet material is confined will be reduced. A small quantity of pellet material will therefore be needed in order to assure a conductive path being formed between the case 19 and the conductive member 27, regardless of the orientation of the switching device. The pellet engaging portions 41 and 43 will touch, as seen in FIG. 2, and limit the rightward movement of the non-conductive spacer 37. As seen in FIG. 2, the fused pellet material 47 will be sufficient to insure such a conductive path being formed.

Although the pellet 35 is held such that it engages the pellet engaging portion 41 of conductive member 27 prior to being fused, it should be understood that the inner and outer diameters of the annular pellet 35 could be increased such that the pellet 35 would not contact the conductive member 27 but would be held in contact with the case 19 prior to fusion. Such a design would work with equal effectiveness. The crucial factor is that the conductive pellet not provide an electrically conductive path prior to fusion.

Figure 4:
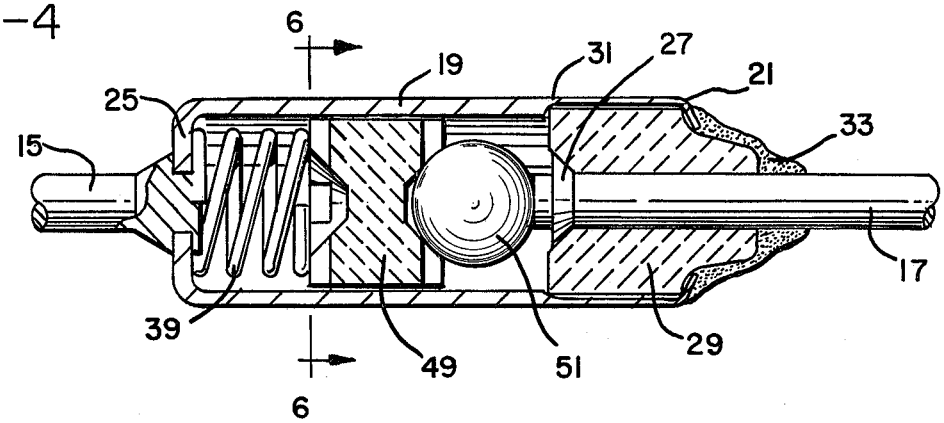
FIG. 4 is a partial sectional view taken generally axially of an alternative embodiment of the present invention, prior to actuation.
Figure 5:
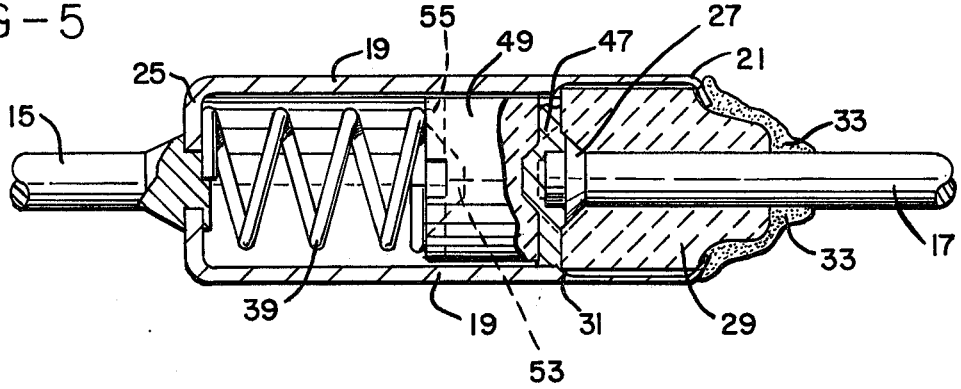
FIG. 5 is a view similar to FIG. 4 showing the switch condition after the switch is heated sufficient to cause switch actuation.
Figure 6:
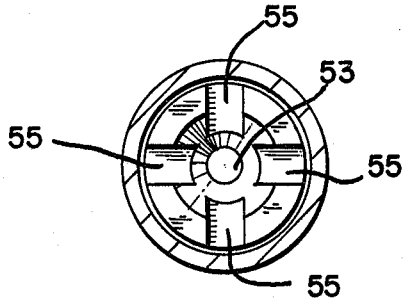
FIG. 6 is a view taken generally along the line 6—6 in FIG. 4.

Reference is now made to FIGS. 4, 5 and 6 in which an alternative embodiment of the present invention is shown. Like numerals are used to identify elements which are identical to those shown in FIGS. 1–3. Non-conductive spacer means 49 is configured somewhat differently from the spacer used in the previous embodiment since it is designed to engage a heat fusible electrically conductive pellet 51 which is substantially spherical in shape. Non-conductive spacer means 49, as seen in FIG. 6 defines recesses 53 on each end, such recesses being dimensioned to engage pellet 51 and, under urging from spring 39, to maintain pellet 51 out of contact with case 19. Recesses 53 are provided on each end of spacer means 49 so that care need not be taken during assembly of the switching device to insure proper orientation of the spacer means with respect to the pellet 51. The non-conductive spacer means 49 also defines a number of grooves 55 which extend outwardly from the recess 53 to the periphery of the spacer 49. Grooves 55 provide flow paths for the melted pellet material 47 to insure that a conductive path is formed by material 47 between the conductive member 27 and the case 19 after fusion of the pellet 51.

While the forms of apparatus herein described constitute preferred embodiments of the invention, it is to be understood that the invention is not limited to these precise forms of apparatus and that changes may be made therein without departing from the scope of the invention.

What is claimed is:

1. A temperature sensitive, electrical switching device, having first and second current carrying electrical leads, for completing an electrical circuit between the first and second electrical leads when the temperature of the switching device exceeds a predetermined temperature level, comprising:

a hollow electrically conductive case having a first end defining an opening into a central cavity and a second end which is closed, said case being electrically connected to said first electrical lead, an electrically conductive member electrically connected to said second lead, non-conductive means for mounting said conductive member such that it extends into said central cavity, said non-conductive means sealing said opening into said cavity, a heat fusible electrically conductive pellet, dimensioned to engage said electrically conductive member without electrically contacting said electrically conductive case, said pellet being fusible at said predetermined temperature level to form a volume of electrically conductive liquid sufficient to establish an electrically conductive path between said case and said member, non-conductive spacer means positioned in said cavity adjacent said heat fusible pellet, and compression spring means in said cavity for urging said non-conductive spacer means against said heat fusible pellet such that said pellet will melt completely at said predetermined temperature level, whereby an open electrical circuit will exist between said first and second electrical leads until said predetermined temperature level is reached and a closed electrical circuit will be formed thereafter between said first and second electrical leads as said spring means and spacer means crush said pellet to insure uniform temperature activation.

2. The temperature sensitive, electrical switching device of claim 1 in which said heat fusible pellet is annular in shape and positioned in said central cavity such that it surrounds said conductive member.

3. The temperature sensitive, electrical switching device of claim 1 in which said pellet is held against said conductive member and out of contact with said conductive case by said spacer means and said spring means.

4. The temperature sensitive, electrical switching device of claim 3 in which said pellet is annular in shape and defines a cylindrical cavity, said conductive member and said spacer means each include pellet engaging portions dimensioned to extend into said cylindrical cavity of said pellet, such that said pellet is held out of engagement with said case by said pellet engaging portions until said pellet is fused.

5. The temperature sensitive, electrical switching device of claim 3 in which said pellet is substantially spherical, said spacer defines a recess, and said pellet is held out of engagement with said case by said recess until said pellet is fused.

6. The temperature sensitive, electrical switching device of claim 5 in which said spacer means further defines grooves extending outwardly from said recess to the periphery of said spacer, said grooves providing flow paths for the melted pellet material.

7. A temperature sensitive electrical switching device, having first and second current carrying electrical leads, for completing an electrical circuit between the first and second electrical leads when the temperature of the switching device exceeds a predetermined temperature level, comprising:

a hollow cylindrical, electrically conductive case having a first end defining an opening into a central cylindrical cavity and a second end which is closed, said case being electrically connected to said first electrical lead, an electrically conductive member electrically connected to said second lead, non-conductive means for mounting said conductive member such that it extends into said cylindrical cavity substantially along the central axis of said cavity, said non-conductive means sealing said opening into said cavity, a heat fusible electrically conductive pellet positioned in said cavity such that said case and said conductive member are electrically isolated, and means, in said cavity, for applying a force to said pellet such that said pellet will fuse at said predetermined temperature level and provide an electrically conductive path between said case and said member, oxidation of the pellet surface therefore not affecting said predetermined temperature level of the device.

8. The temperature sensitive electrical switching device of claim 7 in which said means for applying a force, comprises:

non-conductive spacer means abutting said pellet in said central cylindrical cavity, and spring means for urging said spacer means into contact with said pellet such that a force is applied thereto.

* * * * *